US011246398B2

(12) United States Patent
Forbes

(10) Patent No.: US 11,246,398 B2
(45) Date of Patent: Feb. 15, 2022

(54) TOOTH BRUSH APPARATUS AND METHOD

(71) Applicant: Ludlow D. Forbes, Elizabeth, NJ (US)

(72) Inventor: Ludlow D. Forbes, Elizabeth, NJ (US)

( * ) Notice: Subject to any disclaimer, the term of this patent is extended or adjusted under 35 U.S.C. 154(b) by 359 days.

(21) Appl. No.: 16/597,198

(22) Filed: Oct. 9, 2019

(65) Prior Publication Data

US 2021/0106130 A1 Apr. 15, 2021

(51) Int. Cl.

| | |
|---|---|
| ***A46B 5/00*** | (2006.01) |
| ***A46B 9/04*** | (2006.01) |
| ***A46B 11/00*** | (2006.01) |

(52) U.S. Cl.

CPC ..... *A46B 5/0004* (2013.01); *A46B 5/0012* (2013.01); *A46B 5/0054* (2013.01); *A46B 9/04* (2013.01); *A46B 11/0062* (2013.01); *A46B 2200/1066* (2013.01)

(58) Field of Classification Search

CPC ..... A46B 9/045; A46B 5/0004; A46B 5/0008; A46B 5/0012; A46B 5/002; A46B 5/0054; A46B 5/0075; A46B 11/0062; A46B 11/063

USPC ..... 15/167.2

See application file for complete search history.

(56) References Cited

U.S. PATENT DOCUMENTS

| | | | | |
|---|---|---|---|---|
| 3,109,192 | A * | 11/1963 | Levenson | A61C 17/00 15/210.1 |
| 5,669,097 | A * | 9/1997 | Klinkhammer | A46B 5/002 132/322 |
| 8,359,692 | B2 * | 1/2013 | Brewer | A61C 17/228 15/22.1 |
| 2007/0204413 | A1 * | 9/2007 | Kuznetsov | A46B 5/0012 15/22.2 |
| 2011/0113576 | A1 * | 5/2011 | Yankell | A46B 5/0066 15/167.2 |
| 2012/0321369 | A1 * | 12/2012 | Herr | A46B 5/002 401/175 |
| 2016/0051040 | A1 * | 2/2016 | Nadeau | A46B 5/0029 15/167.2 |

* cited by examiner

*Primary Examiner* — Randall E Chin
(74) *Attorney, Agent, or Firm* — Walter J. Tencza, Jr.

(57) ABSTRACT

A toothbrush apparatus including a handle, and attached first and second U-shaped members, each having first and second sections which are substantially parallel to each other and a third section which is substantially perpendicular to the first and second sections of the respective U-shaped member, which connects the first and second sections of the respective U-shaped member together. The second U-shaped member is attached to the handle, so that the U-shape of the first U-shaped member faces in a substantially opposite direction from the U-shape of the second U-shaped member; and wherein a plurality of toothbrush bristles project from each of the first, second, and third sections of the first and second U-shaped members. One or more channels may be located in the handle, permitting a liquid to flow through at least part of the handle and into an area enclosed by the sections of the respective U-shaped members.

14 Claims, 14 Drawing Sheets

TOOTH BRUSH APPARATUS AND METHOD

FIELD OF THE INVENTION

This invention relates to tooth brush devices.

BACKGROUND OF THE INVENTION

There are various known devices for brushing teeth, such as manual tooth brushes and electric toothbrushes.

SUMMARY OF THE INVENTION

In at least one embodiment, an apparatus is provided comprising: a handle; and a first U-shaped member and having first and second sections which are substantially parallel to each other and a third section which is substantially perpendicular to the first and second sections of the first U-shaped member, which connects the first and second sections of the first U-shaped member together; wherein the first, second, and third sections of the first U-shaped member, together form a U-shape of the first U-shaped member; wherein the first U-shaped member is attached to the handle; and wherein a plurality of toothbrush bristles project from each of the first, second, and third sections.

The apparatus may further include a second U-shaped member having first and second sections which are which are substantially parallel to each other and a third section which is substantially perpendicular to the first and second sections of the second U-shaped member and which connects the first and second sections of the second U-shaped member together; wherein the first, second, and third sections of the second U-shaped member, together form a U-shape of the second U-shaped member; wherein the second U-shaped member is attached to the handle, so that the U-shape of the first U-shaped member faces in a substantially opposite direction from the U-shape of the second U-shaped member; and wherein a plurality of toothbrush bristles project from each of the first, second, and third sections of the second U-shaped member.

In at least one embodiment, a first channel is located in the handle; and wherein the first channel allows a liquid or toothpaste to flow through at least part of the handle and into an area enclosed by first, second, and third sections of the first U-shaped member.

In at least one embodiment of the present application first and second channels may be located in the handle. The first channel may allow a liquid to flow through at least part of the handle and into an area enclosed by first, second, and third sections of the first U-shaped member; and the second channel may allow a liquid to flow through at least part of the handle and into an area enclosed by first, second, and third sections of the second U-shaped member.

The apparatus may further include a pumping device configured to pump liquid through at least part of the handle and into the area enclosed by first, second, and third sections of the first U-shaped member and/or through at least part of the handle and into the area enclosed by the first, second, and third sections of the second U-shaped member.

In at least one embodiment of the present application, the first U-shaped member may be rotatably mounted to the handle which permits the first U-shaped member to rotate with respect to the handle, while attached to the handle; and the second U-shaped member may be rotatably mounted to the handle which permits the second U-shaped member to rotate with respect to the handle, while attached to the handle.

In at least one embodiment of the present application, a first end of the handle is rotatably mounted to a base, and a second end of the handle, which is opposite the first end of the handle, is attached to the first U-shaped member.

The handle may be comprised of first and second handle portions; wherein a first end of the first handle portion is rotatably mounted to a base, and a second end of the first handle portion, which is opposite the first end of the first handle portion, is attached to the first U-shaped member; and wherein a first end of the second handle portion is rotatably mounted to the base, and a second end of the second handle portion, which is opposite the first end of the first handle portion, is attached to the second U-shaped member.

At least one embodiment of the present application includes a method comprising brushing an individual's teeth with an apparatus, wherein the apparatus may be configured as previously described.

DETAILED DESCRIPTION OF THE DRAWINGS

Figure 1:
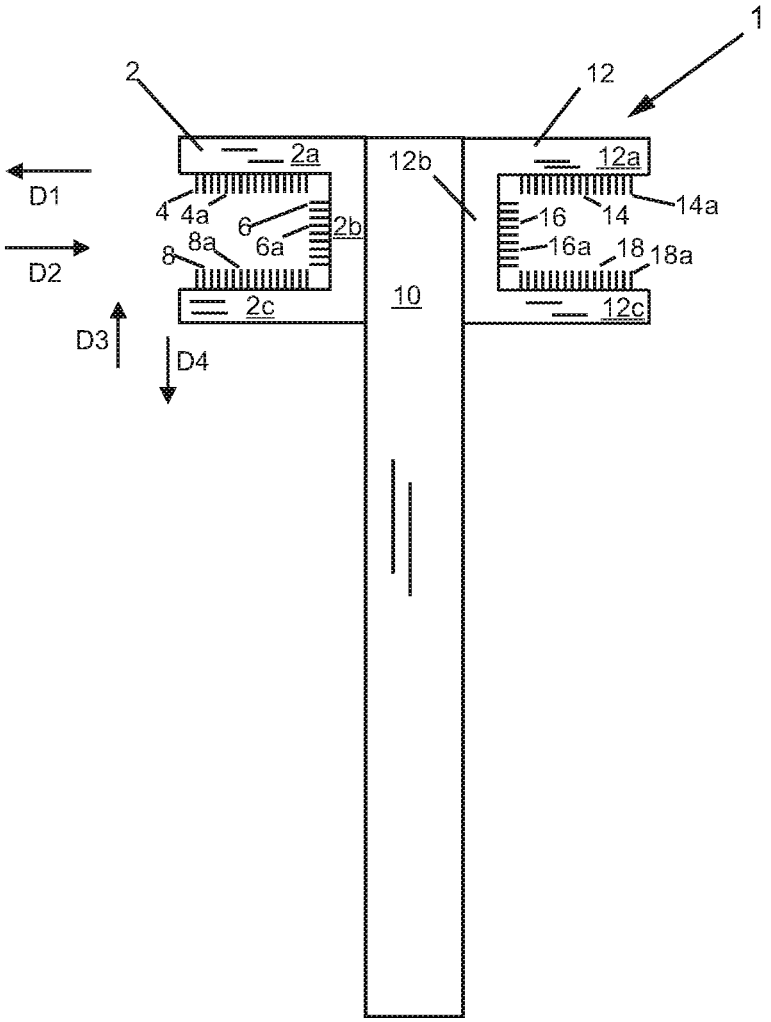
FIG. 1 is a simplified diagram of a side view of a first tooth brush apparatus in accordance with an embodiment of the present invention.

FIG. 1 is a simplified diagram of a side view of a first tooth brush apparatus 1 in accordance with an embodiment of the present invention. The first tooth brush apparatus 1 may include a U-shaped member 2, a handle member 10, and a U-shaped member 12.

The U-shaped member 2 may include members or sections 2*a*, 2*b*, and 2*c*. The member section 2*a* may have a plurality of bristles 4, including bristle 4*a*, fixed to and protruding outwards from and perpendicularly to the member 2*a*. The member or section 2*b* may have a plurality of bristles 6, including bristle 6*a*, fixed to and protruding outwards from and perpendicularly to the member 2*b*. The member or section 2*c* may have a plurality of bristles 8, including bristle 8*a*, fixed to and protruding outwards from and perpendicularly to the member 2*c*.

The U-shaped member 12 may include members or sections 12*a*, 12*b*, and 12*c*. The member section 12*a* may have a plurality of bristles 14, including bristle 14*a*, fixed to and protruding outwards from and perpendicularly to the member 12*a*. The member or section 12*b* may have a plurality of bristles 16, including bristle 16*a*, fixed to and protruding outwards from and perpendicularly to the member 12*b*. The member or section 12*c* may have a plurality of bristles 18, including bristle 18*a*, fixed to and protruding outwards from and perpendicularly to the member 12*c*.

The components 2, 10, and 12 may be made of hard plastic. The bristles 4, 6, 8, 14, 16, and 18 may be made of any suitable known material for tooth brush bristles. The U-shaped members 2 and 12 may be fixed to and/or integrated with the handle member 10. A user or person, may use the apparatus 1 to brush both upper and lower teeth in the person's mouth at the same time. The bristles 4, 6, and 8 attached to the U-shaped member 2 and the bristles 14, 16, and 18 attached to the U-shaped member 12 help to surround or at least partially surround a tooth or a plurality of teeth from the top and from two opposite sides, simultaneously.

In use, an individual would grasp the handle member 10, and brush the individual's upper and lower teeth simultaneously using the bristles 4, 6, 8 (in a first example for an upper tooth or teeth) and bristles 14, 16, and 18 (in the first example for a lower tooth or teeth).

Figure 2:
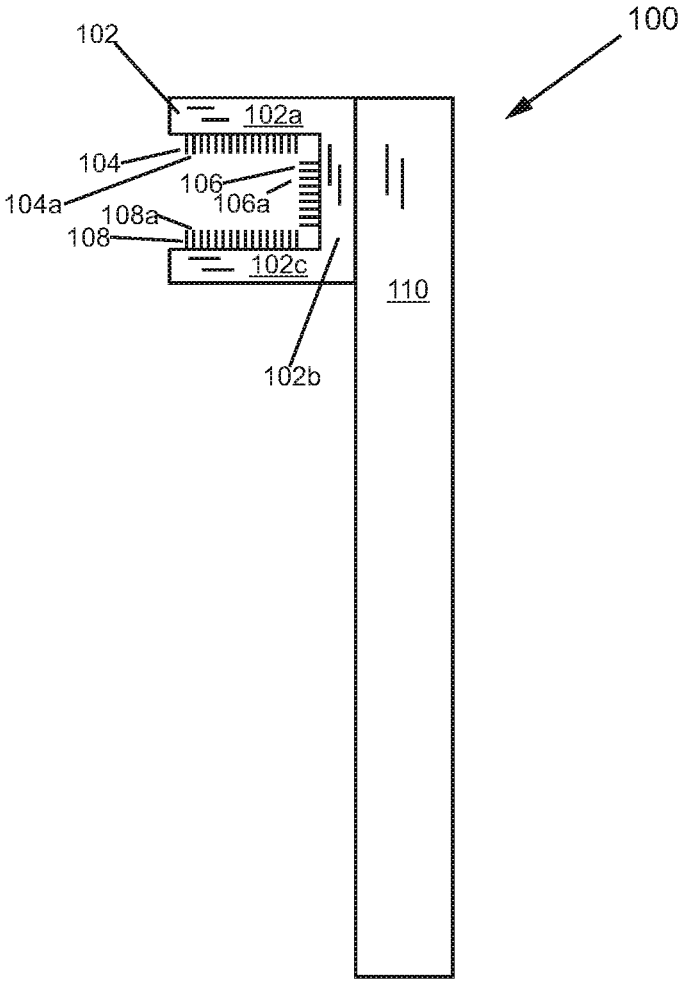
FIG. 2 is a simplified diagram of a side view of a second tooth brush apparatus in accordance with another embodiment of the present invention.

FIG. 2 is a simplified diagram of a side view of a second tooth brush apparatus 100 in accordance with another embodiment of the present invention. The second tooth brush apparatus 100 may include a U-shaped member 102, and a handle member 110. The second tooth brush apparatus 100 differs from the apparatus 1, in that only one U-shaped member is provided in the apparatus 100 of FIG. 2, versus the apparatus 1 of FIG. 1.

The U-shaped member 102 may include members or sections 102*a*, 102*b*, and 102*c*. The member section 102*a* may have a plurality of bristles 104, including bristle 104*a*, fixed to and protruding outwards from and perpendicularly to the member 102*a*. The member or section 102*b* may have a plurality of bristles 106, including bristle 106*a*, fixed to and protruding outwards from and perpendicularly to the member 102*b*. The member or section 102*c* may have a plurality of bristles 108, including bristle 108*a*, fixed to and protruding outwards from and perpendicularly to the member 102*c*.

The components 102, and 110 may be made of hard plastic. The bristles 104, 106, and 108, may be made of any suitable known material for tooth brush bristles. The U-shaped member 102 may be fixed to and/or integrated with the handle member 110. A user or person, may use the apparatus 100 to brush teeth in the person's mouth. The bristles 104, 106, and 108 attached to the U-shaped member 102 help to surround or at least partially surround a tooth or a plurality of teeth from the top and from two opposite sides, simultaneously.

In use, an individual would grasp the handle member 110, and brush an individual's teeth using the bristles 104, 106, and 108.

Figure 3:
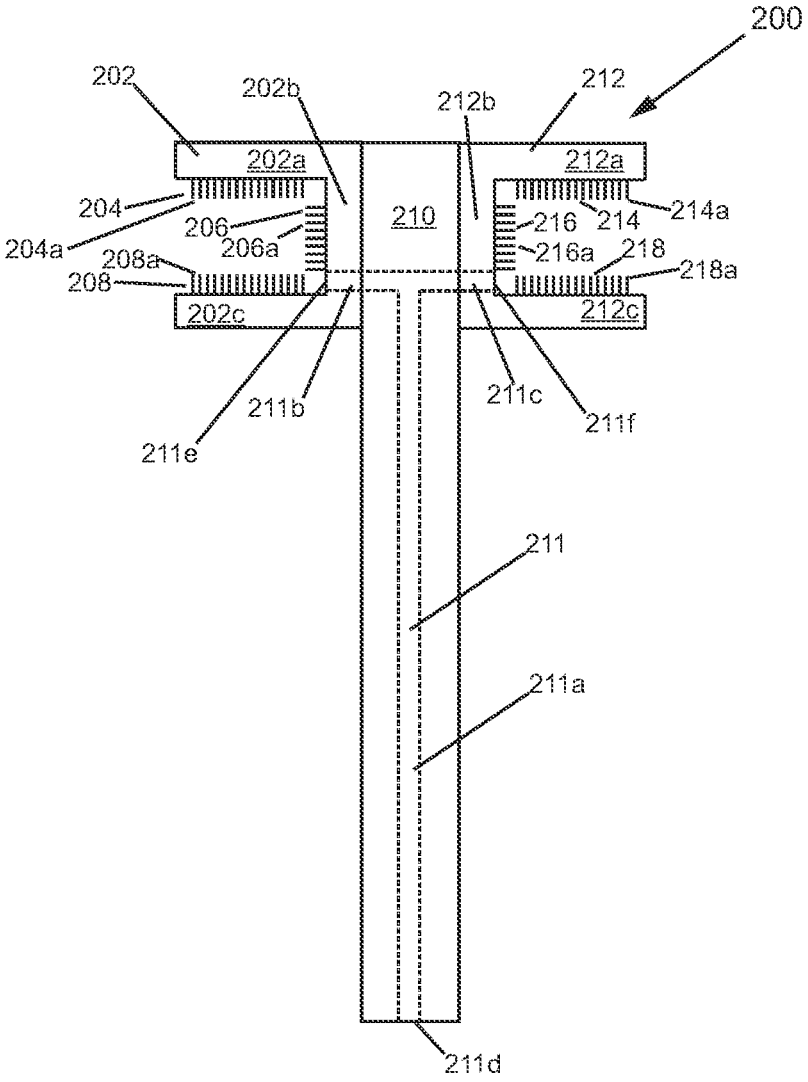
FIG. 3 is a simplified diagram of a side view of a third tooth brush apparatus in accordance with another embodiment of the present invention.

FIG. 3 is a simplified diagram of a side view of a third tooth brush apparatus 200 in accordance with another embodiment of the present invention. The apparatus 200 may be similar to or identical to the apparatus 1, except as will be described. The third tooth brush apparatus 200 may include a U-shaped member 202, a handle member 210, and a U-shaped member 212.

The U-shaped member 202 may include members or sections 202*a*, 202*b*, and 202*c*. The member section 202*a* may have a plurality of bristles 204, including bristle 204*a*, fixed to and protruding outwards from and perpendicularly to the member 202*a*. The member or section 202*b* may have a plurality of bristles 206, including bristle 206*a*, fixed to and protruding outwards from and perpendicularly to the member 202*b*. The member or section 202*c* may have a plurality of bristles 208, including bristle 208*a*, fixed to and protruding outwards from and perpendicularly to the member 202*c*.

The U-shaped member 212 may include members or sections 212*a*, 212*b*, and 212*c*. The member section 212*a* may have a plurality of bristles 214, including bristle 214*a*, fixed to and protruding outwards from and perpendicularly to the member 212*a*. The member or section 212*b* may have a plurality of bristles 216, including bristle 216*a*, fixed to and protruding outwards from and perpendicularly to the member 212*b*. The member or section 212*c* may have a plurality of bristles 218, including bristle 218*a*, fixed to and protruding outwards from and perpendicularly to the member 212*c*.

The components 202, 210, and 212 may be made of hard plastic. The bristles 204, 206, 208, 214, 216, and 218 may be made of any suitable known material for tooth brush bristles. The U-shaped members 202 and 212 may be fixed to and/or integrated with the handle member 210. A user or person, may use the apparatus 200 to brush both upper and lower teeth in the person's mouth at the same time. The bristles 204, 206, and 208 attached to the U-shaped member 202 and the bristles 214, 216, and 218 attached to the U-shaped member 212 help to surround or at least partially surround a tooth or a plurality of teeth from the top and from two opposite sides, simultaneously.

In use, an individual would grasp the handle member 210, and brush the individual's upper and lower teeth simultaneously using the bristles 204, 206, 208 (in a first example for an upper tooth or teeth) and bristles 214, 216, and 218 (in the first example for a lower tooth or teeth).

Unlike in the apparatus 1 of FIG. 1, the apparatus 200 has channel 211, comprised of vertical channel section 211*a*, horizontal channel section 211*b*, and horizontal channel section 211*c*. In operation, water or toothpaste can be inserted or pumped in at an opening at an end 211*d* and caused to move through the channel 211*a*, into channels 211*b* and 211*c*, and out openings 211*e* and 211*f*. The water or toothpaste flowing out the opening 211*e* comes out in an area or gap surrounded, at least partially, by members 202*a-c*, and the water or toothpaste flowing out the openings 211*f* comes out in an area or gap surrounded, at least partially by members 212*a-c*. This allows the water or tooth paste to be applied to a person's teeth.

Figure 4:
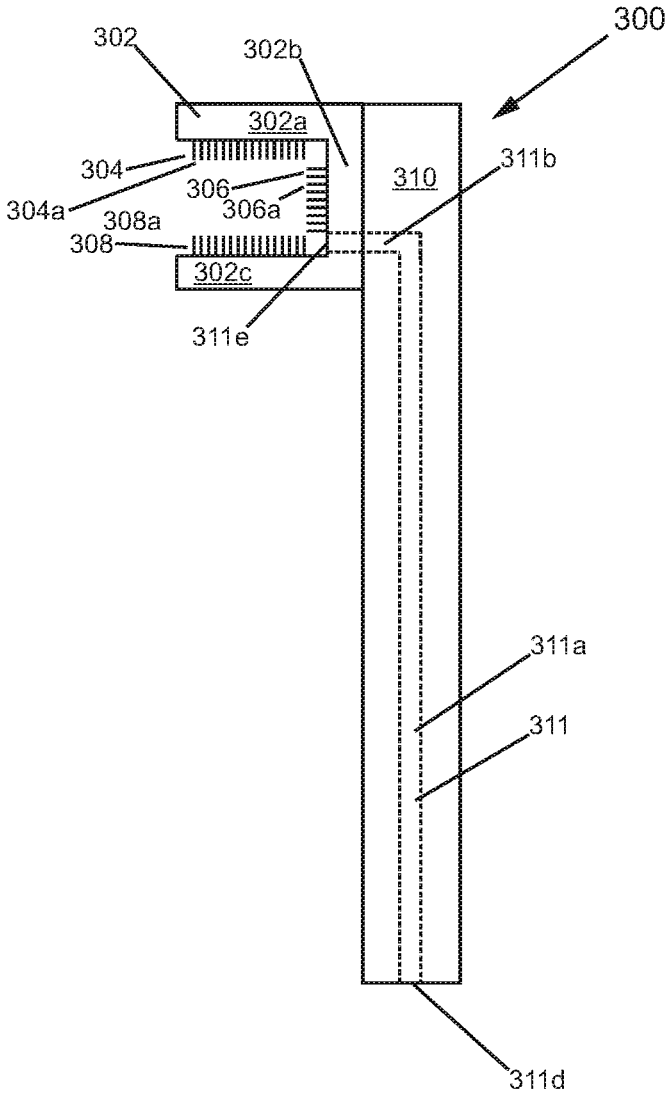
FIG. 4 is a simplified diagram of a side view of a fourth tooth brush apparatus in accordance with another embodiment of the present invention.

FIG. 4 is a simplified diagram of a side view of a fourth tooth brush apparatus 300 in accordance with another embodiment of the present invention.

The fourth tooth brush apparatus 300 may include a U-shaped member 302, and a handle member 310. The fourth tooth brush apparatus 300 differs from the apparatus 1, in that only one U-shaped member 302 is provided in the apparatus 300 of FIG. 4, versus the apparatus 1 of FIG. 1.

The U-shaped member 302 may include members or sections 302*a*, 302*b*, and 302*c*. The member section 302*a* may have a plurality of bristles 304, including bristle 304*a*, fixed to and protruding outwards from and perpendicularly to the member 302*a*. The member or section 302*b* may have a plurality of bristles 306, including bristle 306*a*, fixed to and protruding outwards from and perpendicularly to the member 302*b*. The member or section 302*c* may have a plurality of bristles 308, including bristle 308*a*, fixed to and protruding outwards from and perpendicularly to the member 302*c*.

The components 302, and 310 may be made of hard plastic. The bristles 304, 306, and 308, may be made of any suitable known material for tooth brush bristles. The U-shaped member 302 may be fixed to and/or integrated with the handle member 310. A user or person, may use the apparatus 300 to brush teeth in the person's mouth. The bristles 304, 306, and 308 attached to the U-shaped member 302 help to surround or at least partially surround a tooth or a plurality of teeth from the top and from two opposite sides, simultaneously.

In use, an individual would grasp the handle member 310 typically with one hand, and brush an individual's teeth using the bristles 304, 306, and 308.

Unlike in the apparatus 100 of FIG. 2, the apparatus 300 has channel 311, comprised of vertical channel section 311*a* and horizontal channel section 311*b*. In operation, water or toothpaste can be inserted or pumped in at an opening at an end 311*d* and caused to move through the channel 311*a*, into channel 311*b*, and out opening 311*e*. The water or toothpaste flowing out the opening 311*e* comes out in an area or gap surrounded, at least partially, by members 302*a-c*. This allows the water or tooth paste to be applied to a person's teeth.

Figure 5:
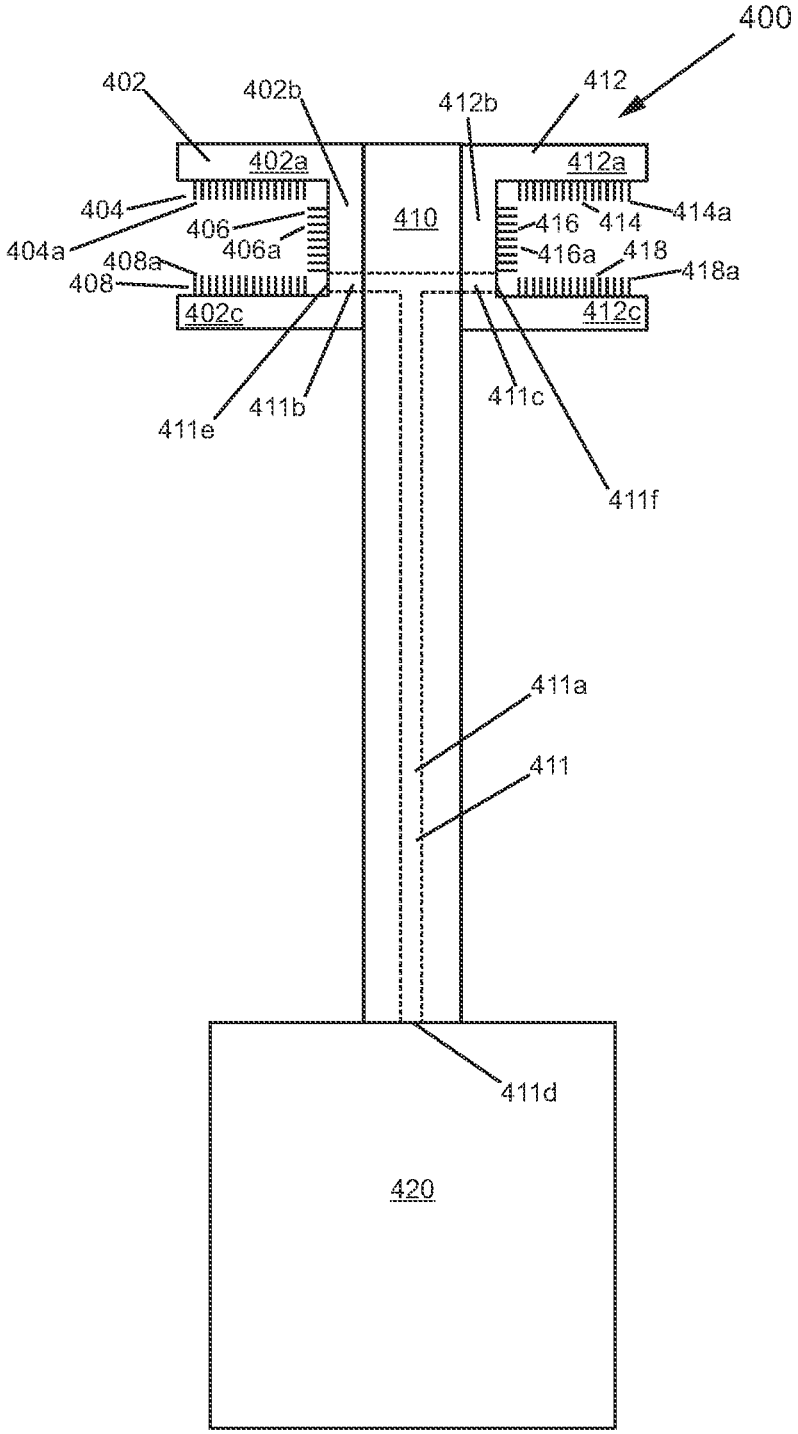
FIG. 5 is a simplified diagram of a side view of a fifth tooth brush apparatus in accordance with another embodiment of the present invention.

FIG. 5 is a simplified diagram of a side view of a fifth tooth brush apparatus 400 in accordance with another embodiment of the present invention.

The fifth tooth brush apparatus 400 may be similar to or identical to the apparatus 200 of FIG. 3, except as will be described. The fifth tooth brush apparatus 400 may include a U-shaped member 402, a handle member 410, and a U-shaped member 412.

The U-shaped member 402 may include members or sections 402*a*, 402*b*, and 402*c*. The member section 402*a* may have a plurality of bristles 404, including bristle 404*a*, fixed to and protruding outwards from and perpendicularly to the member 402*a*. The member or section 402*b* may have a plurality of bristles 406, including bristle 406*a*, fixed to and protruding outwards from and perpendicularly to the member 402*b*. The member or section 402*c* may have a plurality of bristles 408, including bristle 408*a*, fixed to and protruding outwards from and perpendicularly to the member 402*c*.

The U-shaped member 412 may include members or sections 412*a*, 412*b*, and 412*c*. The member section 412*a* may have a plurality of bristles 414, including bristle 414*a*, fixed to and protruding outwards from and perpendicularly to the member 412*a*. The member or section 412*b* may have a plurality of bristles 416, including bristle 416*a*, fixed to and protruding outwards from and perpendicularly to the member 412*b*. The member or section 412*c* may have a plurality of bristles 418, including bristle 418*a*, fixed to and protruding outwards from and perpendicularly to the member 412*c*.

The components 402, 410, and 412 may be made of hard plastic. The bristles 404, 406, 408, 414, 416, and 418 may be made of any suitable known material for tooth brush bristles. The U-shaped members 402 and 412 may be fixed to and/or integrated with the handle member 410. A user or person, may use the apparatus 400 to brush both upper and lower teeth in the person's mouth at the same time. The bristles 404, 406, and 408 attached to the U-shaped member 402 and the bristles 414, 416, and 418 attached to the U-shaped member 412 help to surround or at least partially surround a tooth or a plurality of teeth from the top and from two opposite sides, simultaneously.

In use, an individual would grasp the handle member 410, and brush the individual's upper and lower teeth simultaneously using the bristles 404, 406, 408 (in a first example for an upper tooth or teeth) and bristles 414, 416, and 418 (in the first example for a lower tooth or teeth).

Unlike in the apparatus 1 of FIG. 1, the apparatus 400 has channel 411, comprised of vertical channel section 411*a*, horizontal channel section 411*b*, and horizontal channel section 411*c*. In operation, water or toothpaste can be inserted or pumped in at an opening at an end 411*d* and caused to move through the channel 411*a*, into channels 411*b* and 411*c*, and out openings 411*e* and 411*f*. The water or toothpaste flowing out the opening 411*e* comes out in an area or gap surrounded, at least partially, by members 402*a-c*, and the water or toothpaste flowing out the openings 411*f* comes out in an area or gap surrounded, at least partially by members 412*a-c*. This allows the water or tooth paste to be applied to a person's teeth.

Unlike in the apparatus 200 of FIG. 3, the apparatus 400 of FIG. 5 has a module or device 420. The module or device 420 may include a pump, a reservoir for toothpaste and/or water, a computer processor, a computer memory, and a voice transducer or sensor. The module or device 420 may be programmed by computer software stored in its computer memory to pump toothpaste and/or water into opening 411*d* so it can pass through channel 411*a*, into channels 411*b* and 411*c*, and out openings 411*e* and 411*f*. The module or device 420 may pump toothpaste and/or water into opening 411*d* in response to a voice command received by its voice transducer or sensor to cause its computer processor to activate a pump for pumping toothpaste and/or water into opening 411*d*. The module or device 420 may include a battery for powering its one or more pumps, and/or may have an electrical cord for connecting to an electrical outlet for powering one or more pumps for pumping toothpaste and/or water into opening 411*d*.

Figure 6:
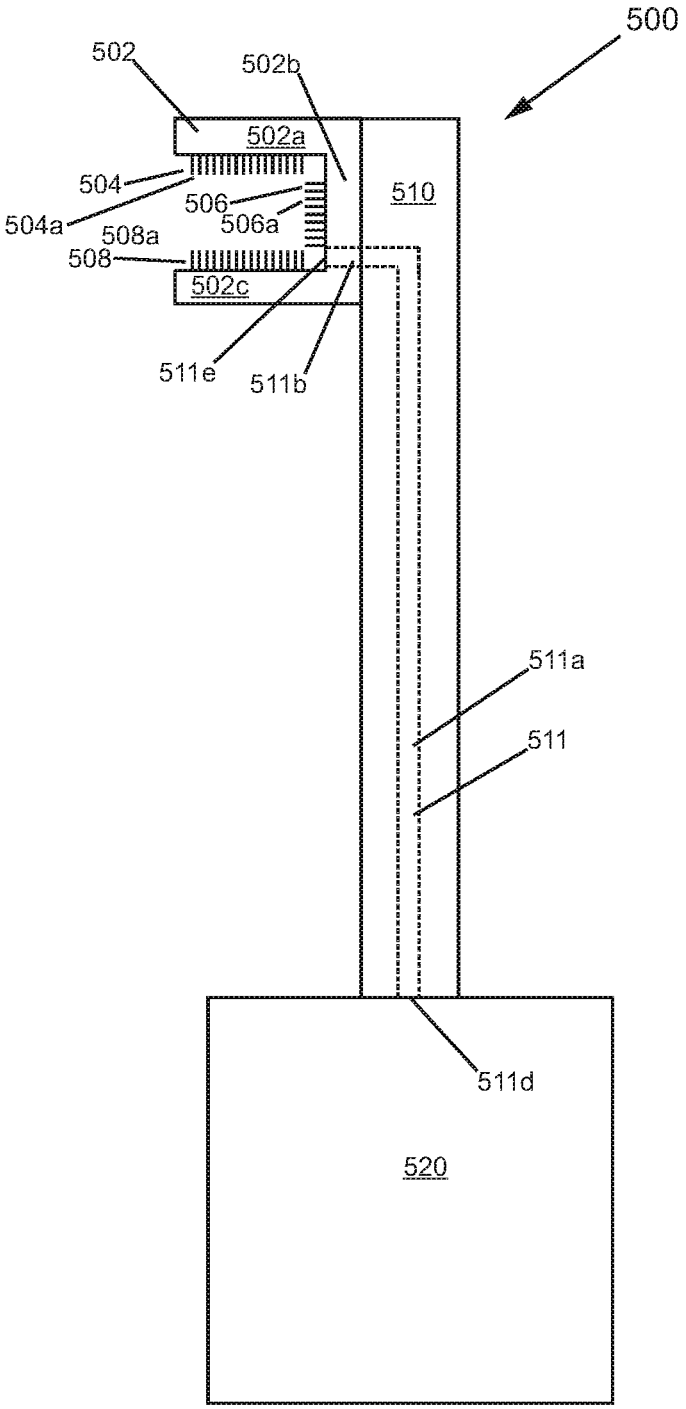
FIG. 6 is a simplified diagram of a side view of a sixth tooth brush apparatus in accordance with another embodiment of the present invention.

FIG. 6 is a simplified diagram of a side view of a sixth tooth brush apparatus 500 in accordance with another embodiment of the present invention.

The sixth tooth brush apparatus 500 may include a U-shaped member 502, and a handle member 510. The fourth tooth brush apparatus 500 differs from the apparatus 1, in that only one U-shaped member 502 is provided in the apparatus 500 of FIG. 6, versus the apparatus 1 of FIG. 1.

The U-shaped member 502 may include members or sections 502*a*, 502*b*, and 502*c*. The member section 502*a* may have a plurality of bristles 504, including bristle 504*a*, fixed to and protruding outwards from and perpendicularly to the member 502*a*. The member or section 502*b* may have a plurality of bristles 506, including bristle 506*a*, fixed to and protruding outwards from and perpendicularly to the member 502*b*. The member or section 502*c* may have a plurality of bristles 508, including bristle 508*a*, fixed to and protruding outwards from and perpendicularly to the member 502*c*.

The components 502, and 510 may be made of hard plastic. The bristles 504, 506, and 508, may be made of any suitable known material for tooth brush bristles. The U-shaped member 502 may be fixed to and/or integrated with the handle member 510. A user or person, may use the apparatus 500 to brush teeth in the person's mouth. The bristles 504, 506, and 508 attached to the U-shaped member 502 help to surround or at least partially surround a tooth or a plurality of teeth from the top and from two opposite sides, simultaneously.

In use, an individual would grasp the handle member 510 typically with one hand, and brush an individual's teeth using the bristles 504, 506, and 508.

Unlike in the apparatus 100 of FIG. 2, the apparatus 500 has channel 511, comprised of vertical channel section 511*a* and horizontal channel section 511*b*. In operation, water or toothpaste can be inserted or pumped in at an opening at an end 511*d* and caused to move through the channel 511*a*, into channel 511*b*, and out opening 511*e*. The water or toothpaste flowing out the opening 511*e* comes out in an area or gap surrounded, at least partially, by members 502*a-c*. This allows the water or tooth paste to be applied to a person's teeth.

Unlike in the apparatus 300 of FIG. 4, the apparatus 500 of FIG. 6 has a module or device 520. The module or device 520 may include a pump, a reservoir for toothpaste and/or water, a computer processor, a computer memory, and a voice transducer or sensor. The module or device 520 may be programmed by computer software stored in its computer memory to pump toothpaste and/or water into opening 511*d* so it can pass through channel 511*a*, into channel 511*b*, and out opening 511*e*. The module or device 520 may pump toothpaste and/or water into opening 511*d* in response to a voice command received by its voice transducer or sensor to cause its computer processor to activate a pump for pumping toothpaste and/or water into opening 511*d*. The module or device 520 may include a battery for powering its one or more pumps, and/or may have an electrical cord for connecting to an electrical outlet for powering one or more pumps for pumping toothpaste and/or water into opening 511*d*.

Figure 7:
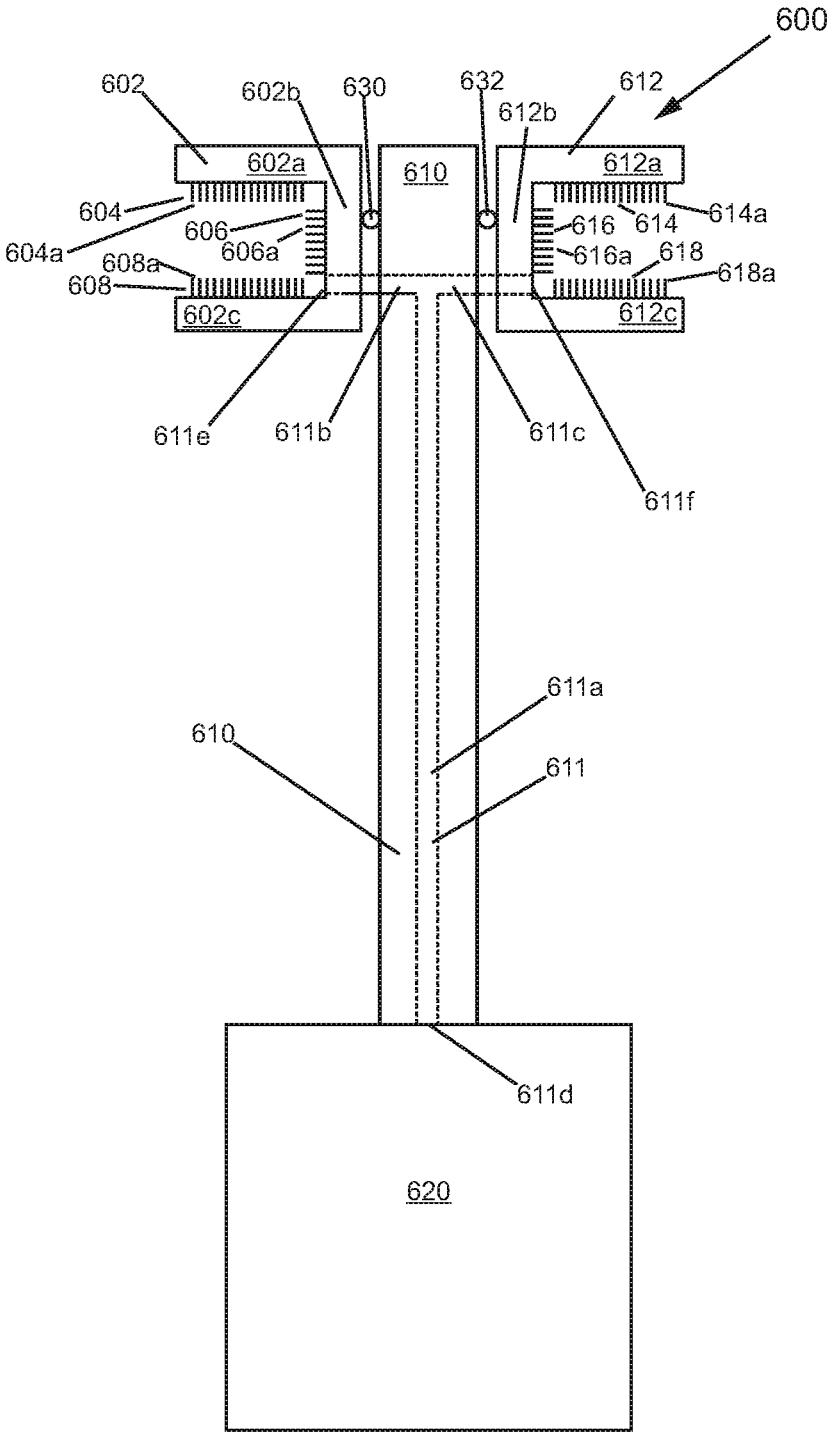
FIG. 7 is a simplified diagram of a side view of a seventh tooth brush apparatus in accordance with another embodiment of the present invention.

FIG. 7 is a simplified diagram of a side view of a seventh tooth brush apparatus 600 in accordance with another embodiment of the present invention. The apparatus 600 may be similar or identical to the apparatus 400 of FIG. 5 except as will be described.

The seventh tooth brush apparatus 600 may include a U-shaped member 602, a handle member 610, and a U-shaped member 612.

The U-shaped member 602 may include members or sections 602*a*, 602*b*, and 602*c*. The member section 602*a* may have a plurality of bristles 604, including bristle 604*a*, fixed to and protruding outwards from and perpendicularly to the member 602*a*. The member or section 602*b* may have a plurality of bristles 606, including bristle 606*a*, fixed to and protruding outwards from and perpendicularly to the member 602*b*. The member or section 602*c* may have a plurality of bristles 608, including bristle 608*a*, fixed to and protruding outwards from and perpendicularly to the member 602*c*.

The U-shaped member 612 may include members or sections 612*a*, 612*b*, and 612*c*. The member section 612*a* may have a plurality of bristles 614, including bristle 614*a*, fixed to and protruding outwards from and perpendicularly to the member 612*a*. The member or section 612*b* may have a plurality of bristles 616, including bristle 616*a*, fixed to and protruding outwards from and perpendicularly to the member 612*b*. The member or section 612*c* may have a plurality of bristles 618, including bristle 618*a*, fixed to and protruding outwards from and perpendicularly to the member 612*c*.

The components 602, 610, and 612 may be made of hard plastic. The bristles 604, 606, 608, 612, 616, and 618 may be made of any suitable known material for tooth brush bristles.

The U-shaped members 602 and 612 may be fixed rotatably mounted to the handle member 610 through connecting rotatable heads or pin devices 630 and 632, respectively.

A user or person, may use the apparatus 600 to brush both upper and lower teeth in the person's mouth at the same time. The bristles 604, 606, and 608 attached to the U-shaped member 602 and the bristles 614, 616, and 618 attached to the U-shaped member 612 help to surround or at least partially surround a tooth or a plurality of teeth from the top and from two opposite sides, simultaneously.

In use, an individual would grasp the handle member 610, typically near component 620, and brush the individual's upper and lower teeth simultaneously using the bristles 604, 606, 608 (in a first example for an upper tooth or teeth) and bristles 614, 616, and 618 (in the first example for a lower tooth or teeth).

The apparatus 600 has channel 611, comprised of vertical channel section 611*a*, horizontal channel section 611*b*, and horizontal channel section 611*c*. The channel sections 611*a*, *b*, and c may be made of flexible tubing so that they can expand and contract, when U-shaped member 602 rotates with respect to handle member 610 and when U-shaped member 612 rotates with respect to the handle member 610.

In operation, water or toothpaste can be inserted or pumped in at an opening at an end 611*d* and caused to move through the channel 611*a*, into channels 611*b* and 611*c*, and out openings 611*e* and 611*f*. The water or toothpaste flowing out the opening 611*e* comes out in an area or gap surrounded, at least partially, by members 602*a-c*, and the water or toothpaste flowing out the openings 611*f* comes out in an area or gap surrounded, at least partially by members 612*a-c*. This allows the water or tooth paste to be applied to a person's teeth.

The apparatus 600 of FIG. 7 has a module or device 620. The module or device 620 may include a pump, a reservoir for toothpaste and/or water, a computer processor, a computer memory, and a voice transducer or sensor. The module or device 620 may be programmed by computer software stored in its computer memory to pump toothpaste and/or water into opening 611*d* so it can pass through channel 611*a*, into channels 611*b* and 611*c*, and out openings 611*e* and 611*f*. The module or device 620 may pump toothpaste and/or water into opening 611*d* in response to a voice command received by its voice transducer or sensor to cause its computer processor to activate a pump for pumping toothpaste and/or water into opening 611*d*. The module or device 620 may include a battery for powering its one or more pumps, and/or may have an electrical cord for connecting to an electrical outlet for powering one or more pumps for pumping toothpaste and/or water into opening 611*d*.

Figure 8:
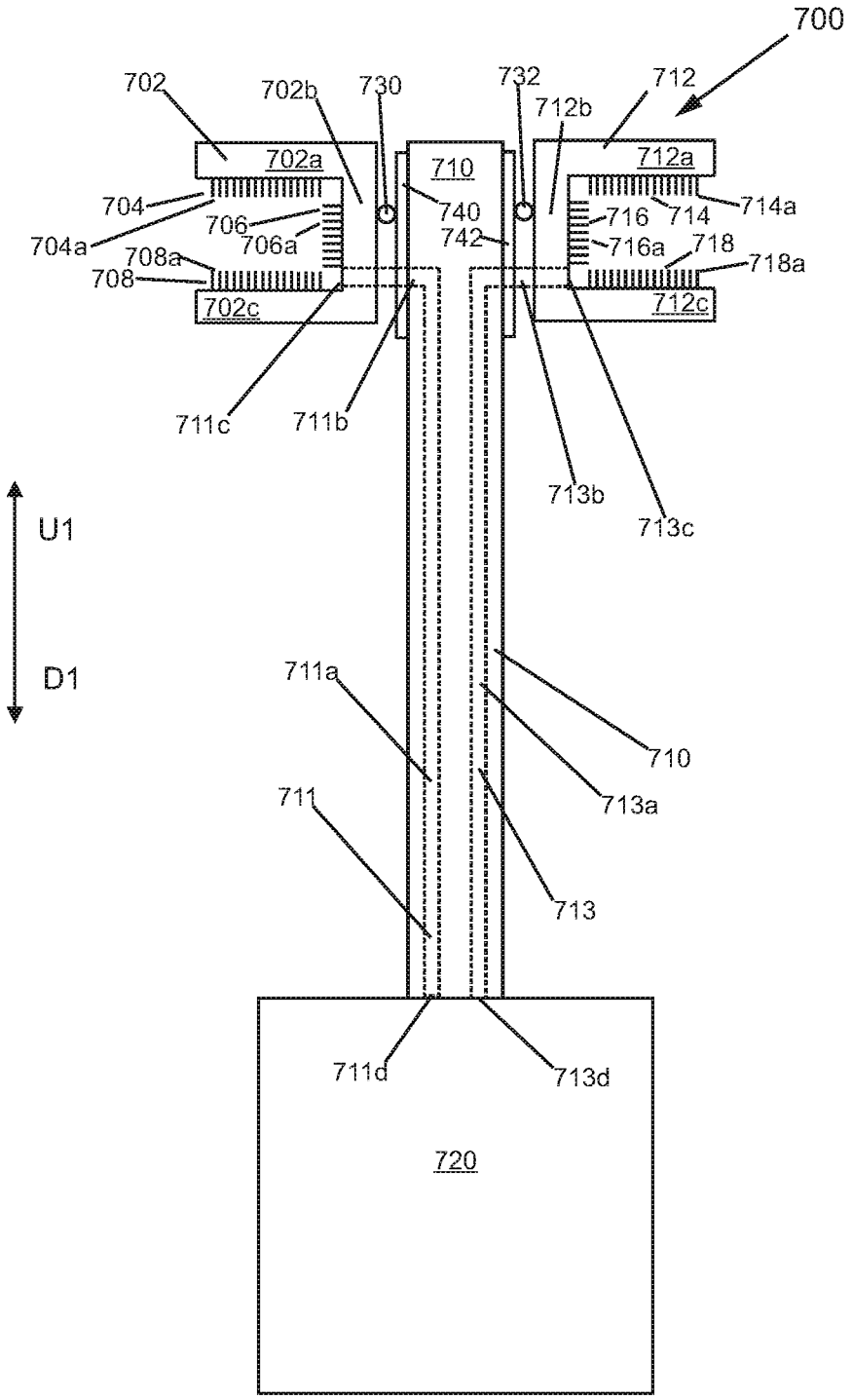
FIG. 8 is a simplified diagram of a side view of an eighth tooth brush apparatus in accordance with another embodiment of the present invention.

FIG. 8 is a simplified diagram of a side view of an eighth tooth brush apparatus 700 in accordance with another embodiment of the present invention. The apparatus 700 may be similar or identical to the apparatus 600 of FIG. 7, except as will be described.

The eighth tooth brush apparatus 700 may include a U-shaped member 702, a handle member 710, and a U-shaped member 712.

The U-shaped member 702 may include members or sections 702*a*, 702*b*, and 702*c*. The member section 702*a* may have a plurality of bristles 704, including bristle 704*a*, fixed to and protruding outwards from and perpendicularly to the member 702*a*. The member or section 702*b* may have a plurality of bristles 706, including bristle 706*a*, fixed to and protruding outwards from and perpendicularly to the member 702*b*. The member or section 702*c* may have a plurality of bristles 708, including bristle 708*a*, fixed to and protruding outwards from and perpendicularly to the member 702*c*.

The U-shaped member 712 may include members or sections 712*a*, 712*b*, and 712*c*. The member section 712*a* may have a plurality of bristles 714, including bristle 714*a*, fixed to and protruding outwards from and perpendicularly to the member 712*a*. The member or section 712*b* may have a plurality of bristles 716, including bristle 716*a*, fixed to and protruding outwards from and perpendicularly to the member 712*b*. The member or section 712*c* may have a plurality of bristles 718, including bristle 718*a*, fixed to and protruding outwards from and perpendicularly to the member 712*c*.

The components 702, 710, and 712 may be made of hard plastic. The bristles 704, 706, 708, 712, 716, and 718 may be made of any suitable known material for tooth brush bristles.

The U-shaped members 702 and 712 may be fixed rotatably mounted to the handle member 710 through pin devices 730 and 732, which are connected to plates or members 740 and 742, respectively. Unlike the apparatus 600 of FIG. 7, in the apparatus 700 of FIG. 8, plates 740 and 742 are provided which are configured to slide up and down, in the direction U1 and D1, respectively, in channels of the handle member 710. The plate 740 slides up and down in a channel on one side of the handle member 710 and the plate 742 slides up and down in a channel on an opposite side of the handle member 710. This allows the position of the U-shaped members 702 and 712 to be adjusted with respect to the module or device 720.

A user or person, may use the apparatus 700 to brush both upper and lower teeth in the person's mouth at the same time. The bristles 704, 706, and 708 attached to the U-shaped member 702 and the bristles 714, 716, and 718 attached to the U-shaped member 712 help to surround or at least partially surround a tooth or a plurality of teeth from the top and from two opposite sides, simultaneously.

In use, an individual would grasp the handle member 710, typically near component 720, and brush the individual's upper and lower teeth simultaneously using the bristles 704, 706, 708 (in a first example for an upper tooth or teeth) and bristles 714, 716, and 718 (in the first example for a lower tooth or teeth).

The apparatus 700 has channels 711 and 713. Channel 711 is comprised of vertical channel section 711*a*, and horizontal channel section 711*b*. Channel 713 is comprised of vertical channel section 713*a*, and horizontal channel section 713*b*. The channel sections 711*a*, 711*b*, 713*a* and 713*b* may be made of flexible tubing so that they can expand and contract, when U-shaped member 702 rotates, or slides up and down in direction U1 or D1 with respect to handle member 710 and when U-shaped member 712 rotates, or slides up and down in direction U1 and D1, with respect to the handle member 710.

In operation, water or toothpaste can be inserted or pumped in at an opening at an end 711*d* and/or 713*d* and caused to move through the channel 711*a* and/or 713*a*, into channels 711*b* and/or 713*b*, and out openings 711*c* and/or 713*c*. The water or toothpaste flowing out the opening 711*c* comes out in an area or gap surrounded, at least partially, by members 702*a-c*, and the water or toothpaste flowing out the openings 713*c* comes out in an area or gap surrounded, at least partially by members 712*a-c*. This allows the water or tooth paste to be applied to a person's teeth.

The apparatus 700 of FIG. 8 has a module or device 720. The module or device 720 may include a pump, a reservoir for toothpaste and/or water, a computer processor, a computer memory, and a voice transducer or sensor. The module or device 720 may be programmed by computer software stored in its computer memory to pump toothpaste and/or water into opening 711*d* and/or 713*d* so it can pass through channel 711*a* and/or 713*a*, into channels 711*b* and/or 713*b*, and out openings 711*c* and/or 713*c*. The module or device 720 may pump toothpaste and/or water into opening 711*d* and/or 713*d* in response to a voice command received by its voice transducer or sensor to cause its computer processor to activate a pump for pumping toothpaste and/or water into opening 711*d* and/or opening 713*d*. The module or device 720 may include a battery for powering its one or more pumps, and/or may have an electrical cord for connecting to an electrical outlet for powering one or more pumps for pumping toothpaste and/or water into opening 711*d* and/or opening 713*d*. The battery inside the module or device 720 may be rechargeable.

Figure 9:
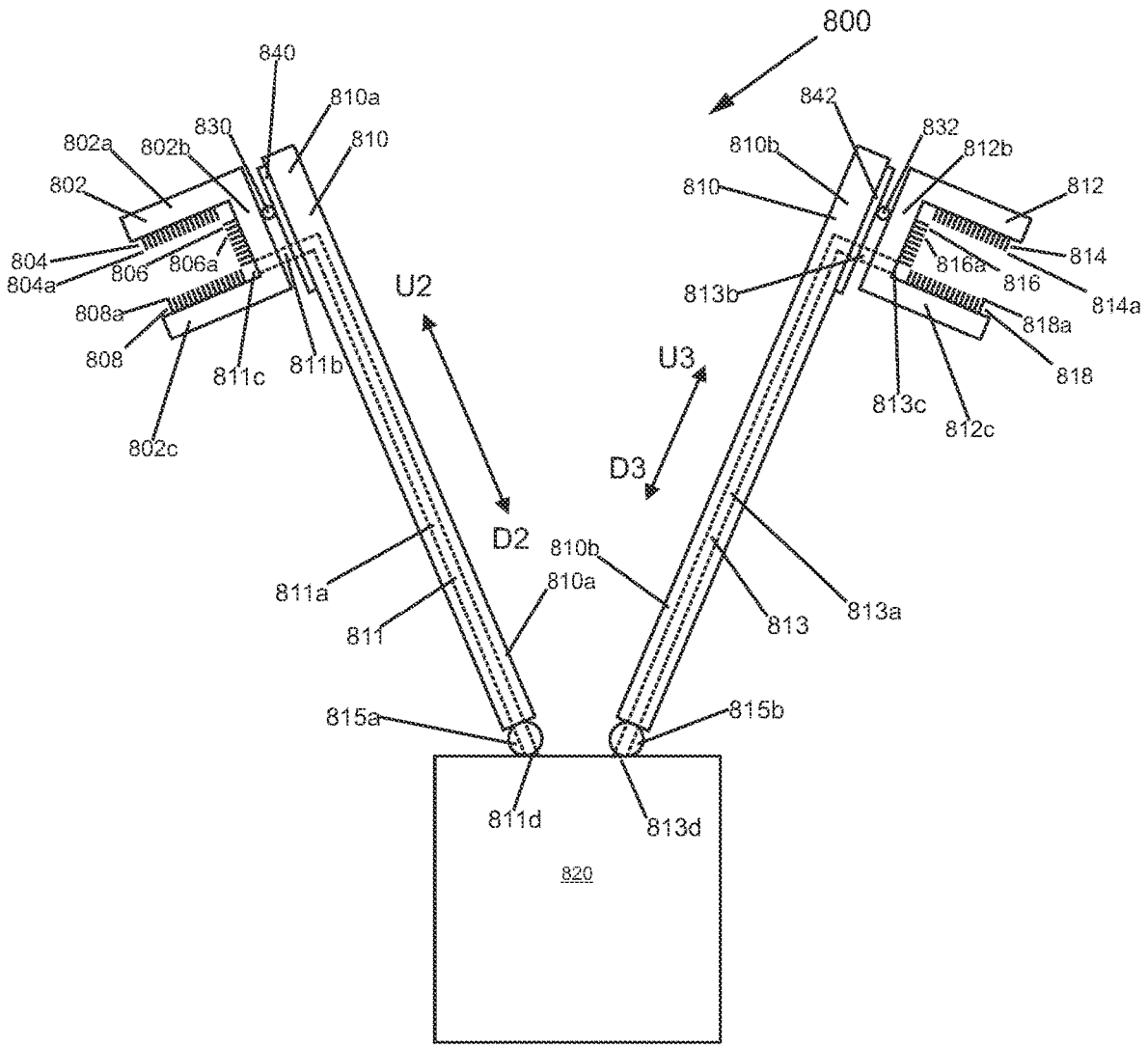
FIG. 9 is a simplified diagram of a side view of a ninth tooth brush apparatus in accordance with another embodiment of the present invention.

FIG. 9 is a simplified diagram of a side view of a ninth tooth brush apparatus 800 in accordance with another embodiment of the present invention. The apparatus 800 may be similar or identical to the apparatus 700 of FIG. 8, except as will be described.

The ninth tooth brush apparatus 800 may include a U-shaped member 802, handle members 810*a* and 810*b*, and a U-shaped member 812. The handle member 810*a* may be rotatably mounted to the device and/or housing 820 by a pivot pin or device 815*a* and the handle member 810*b* may be rotatably mounted to the device and/or housing 820 by a pivot pin or device 815*b*.

The U-shaped member 802 may include members or sections 802*a*, 802*b*, and 802*c*. The member section 802*a* may have a plurality of bristles 804, including bristle 804*a*, fixed to and protruding outwards from and perpendicularly to the member 802*a*. The member or section 802*b* may have a plurality of bristles 806, including bristle 806*a*, fixed to and protruding outwards from and perpendicularly to the member 802*b*. The member or section 802*c* may have a plurality of bristles 808, including bristle 808*a*, fixed to and protruding outwards from and perpendicularly to the member 802*c*.

The U-shaped member 812 may include members or sections 812*a*, 812*b*, and 812*c*. The member section 812*a* may have a plurality of bristles 814, including bristle 814*a*, fixed to and protruding outwards from and perpendicularly to the member 812*a*. The member or section 812*b* may have a plurality of bristles 816, including bristle 816*a*, fixed to and protruding outwards from and perpendicularly to the member 812*b*. The member or section 812*c* may have a plurality of bristles 818, including bristle 818*a*, fixed to and protruding outwards from and perpendicularly to the member 812*c*.

The components 802, 810, and 812 may be made of hard plastic. The bristles 804, 806, 808, 812, 816, and 818 may be made of any suitable known material for tooth brush bristles.

The U-shaped members 802 and 812 may be fixed rotatably mounted to the handle member 810 through pin devices 830 and 832, which are connected to plates or members 840 and 842, respectively. Plates 840 and 842 are provided which are configured to slide up and down, in the directions U2 and U3, and D2 and D3, in channels of the housings 810*a* and 810*b*, respectively. The plate 840 slides up and down in a channel on one side of the housing 810*a* and the plate 842 slides up and down in a channel on an opposite side of the apparatus 810*b*. This allows the position of the U-shaped members 802 and 812 to be adjusted with respect to the housing or device 820.

A user or person, may use the apparatus 800 to brush both upper and lower teeth in the person's mouth at the same time. The bristles 804, 806, and 808 attached to the U-shaped member 802 and the bristles 814, 816, and 818 attached to the U-shaped member 812 help to surround or at least partially surround a tooth or a plurality of teeth from the top and from two opposite sides, simultaneously.

In use, an individual would grasp the handle member 810, typically near component 820, and brush the individual's upper and lower teeth simultaneously using the bristles 804, 806, 808 (in a first example for an upper tooth or teeth) and bristles 814, 816, and 818 (in the first example for a lower tooth or teeth).

The apparatus 800 has channels 811 and 813. Channel 811 is comprised of vertical channel section 811*a*, and horizontal channel section 811*b*. Channel 813 is comprised of vertical channel section 813*a*, and horizontal channel section 813*b*. The channel sections 811*a*, 811*b*, 813*a* and 813*b* may be made of flexible tubing so that they can expand and contract, when U-shaped member 802 rotates, or slides up and down in direction U2 or D2 with respect to handle member 810*a* and when U-shaped member 812 rotates, or slides up and down in direction U3 and D3, with respect to the handle member 810*b*.

In operation, water or toothpaste can be inserted or pumped in at an opening at an end 811*d* and/or 813*d* and caused to move through the channel 811*a* and/or 813*a*, into channels 811*b* and/or 813*b*, and out openings 811*c* and/or 813*c*. The water or toothpaste flowing out the opening 811*c* comes out in an area or gap surrounded, at least partially, by members 802*a-c*, and the water or toothpaste flowing out the openings 813*c* comes out in an area or gap surrounded, at least partially by members 812*a-c*. This allows the water or tooth paste to be applied to a person's teeth.

The apparatus 800 of FIG. 8 has a module or device 820. The module or device 820 may include a pump, a reservoir for toothpaste and/or water, a computer processor, a computer memory, and a voice transducer or sensor. The module or device 820 may be programmed by computer software stored in its computer memory to pump toothpaste and/or water into opening 811*d* and/or 813*d* so it can pass through channel 811*a* and/or 813*a*, into channels 811*b* and/or 813*b*, and out openings 811*c* and/or 813*c*. The module or device 820 may pump toothpaste and/or water into opening 811*d* and/or 813*d* in response to a voice command received by its voice transducer or sensor to cause its computer processor to activate a pump for pumping toothpaste and/or water into opening 811*d* and/or opening 813*d*. The module or device 820 may include a battery for powering its one or more pumps, and/or may have an electrical cord for connecting to an electrical outlet for powering one or more pumps for pumping toothpaste and/or water into opening 811*d* and/or opening 813*d*.

In at least one embodiment, the apparatus 800 provides a scissor structure when open and when in use, including the housing or members 810*a* and 810*b*. These brush heads, in at least one embodiment, may possess a ball joint structure connection, such as pins or balls 830 and 832 that allows the brush heads, or U-shaped members 802 and 812 to pivot and move independently, while still connected to the tooth paste reservoir of housing or device 820 that dispenses tooth paste to one or more of the U-shaped brush heads of 802 and 812. There may also be a slidable or movable knob apparatus that will regulate the movement of both U-shaped brush heads 802 and 812 at the same time that a user brushes their teeth.

Figure 10:
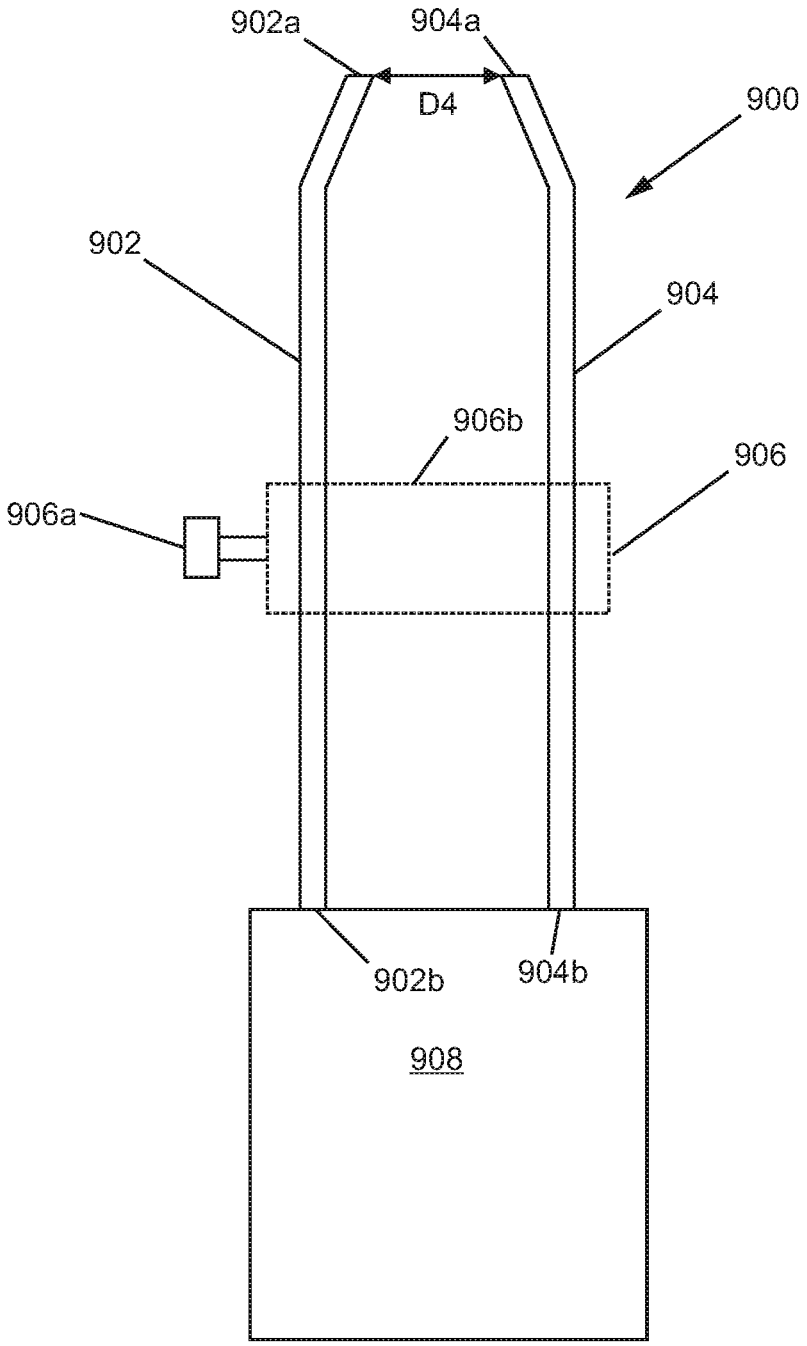
FIG. 10 is a simplified diagram of a side view of a tenth tooth brush apparatus in accordance with another embodiment of the present invention.

FIG. 10 is a simplified diagram of a side view of a tenth tooth brush apparatus 900 in accordance with another embodiment of the present invention. FIG. 10 shows a simplified diagram of an embodiment of a double headed water pick type apparatus 900 connected to a reservoir at the bottom. The apparatus 900 includes tips, flossers, and/or irrigators 902 and 904, space adjustment device 906, and housing 908.

In operation, a knob 906*a* can be turned, for example, clockwise to cause a housing 906*b* to retract or reduce in size to bring the tops 902*a* and 904*a* of the tips or flossers 902 and 904, respectively closer together, i.e. reduce the distance D4. The knob 906*a* is configured to be turned in the opposite direction, such as counterclockwise to cause the device 906 to expand, which increases the distance D4 between the tops 902*a* and 904 of the tips or flossers 902 and 904.

Figure 14:
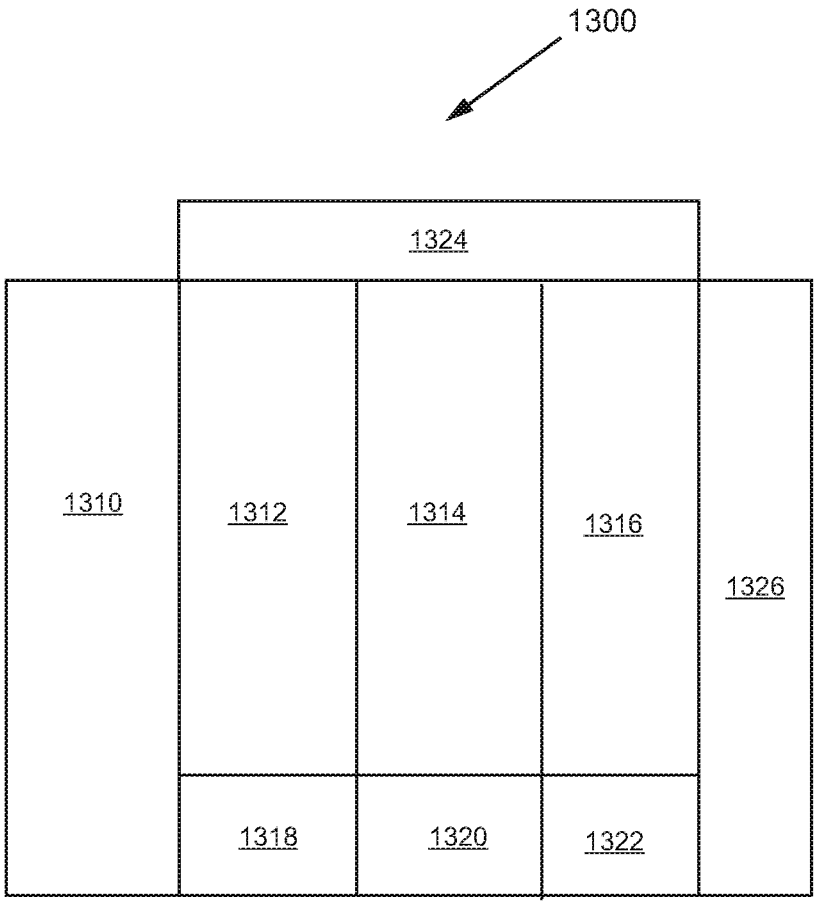
FIG. 14 is a simplified top view of a kit including a plurality of compartments for storing one or more tooth brush apparatuses.

Fluid is configured to flow from a reservoir in the housing 908 through opening 902*b* into tip or flosser 902 and out opening 902*a* into a person's mouth for flossing or rinsing teeth. Similarly, or identically fluid is configured to flow a reservoir in housing 908 through opening 904*b* into tip or flosser 904 and out opening 904*a* into a person's mouth for flossing or rinsing teeth. Fluid, such as water may be provided out of the openings 902*a* and 904*a* simultaneously. The water reservoir in the housing 908 may alternatively be in 1310 kit as shown in FIG. 14.

Figure 11:
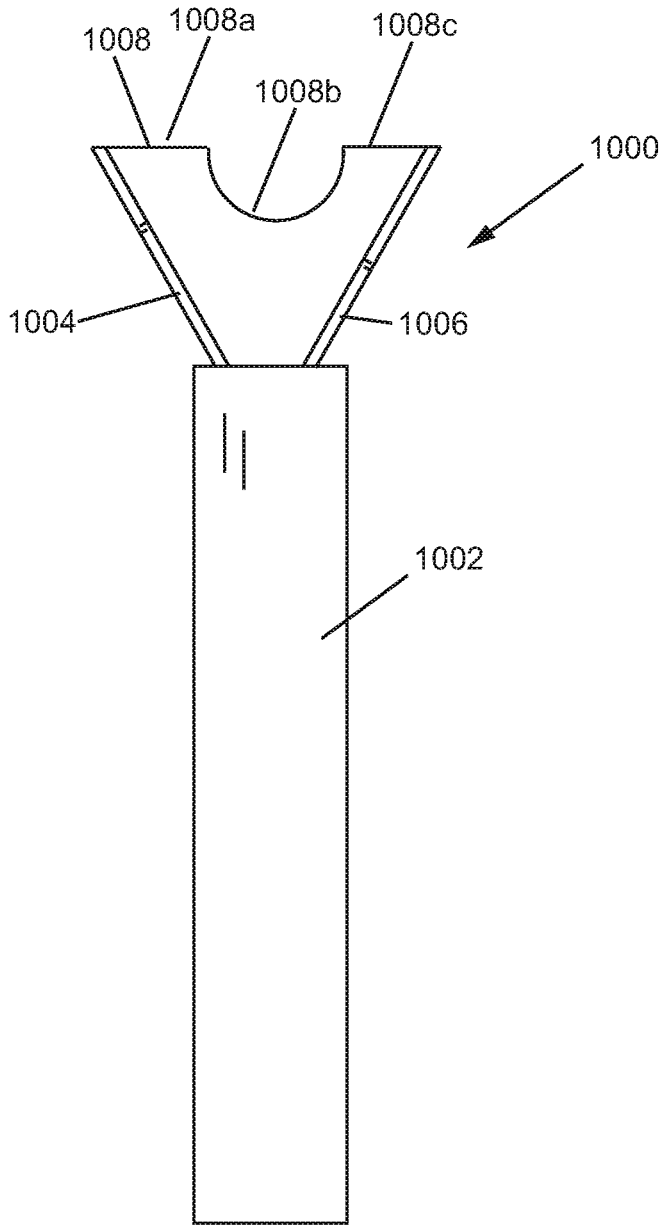
FIG. 11 is a simplified diagram of a side view of an eleventh tooth brush apparatus in accordance with another embodiment of the present invention.

FIG. 11 is a simplified diagram of a side view of an eleventh tooth brush apparatus 1000 in accordance with another embodiment of the present invention.

The apparatus 1000 may have a handle 1002, from which members 1004 and 1006 protrude. The apparatus 1000 may also include a string 1008 having straight, curved, and straight portions, 1008*a*, 1008*b*, and 1008*c*, respectively. The curved portion 1008*b* aids in flossing of teeth. The curved portion 1008*b* is preferably C-shaped and allows a user to rap the curved portion 1008*b* around a particular tooth or teeth. The apparatus 1000 may be removable from an overall unit, and the apparatus 1000 may be disposable. In one embodiment, the handle 1002 may be attached to a housing which includes voice commands and/or buttons.

Figure 12A:
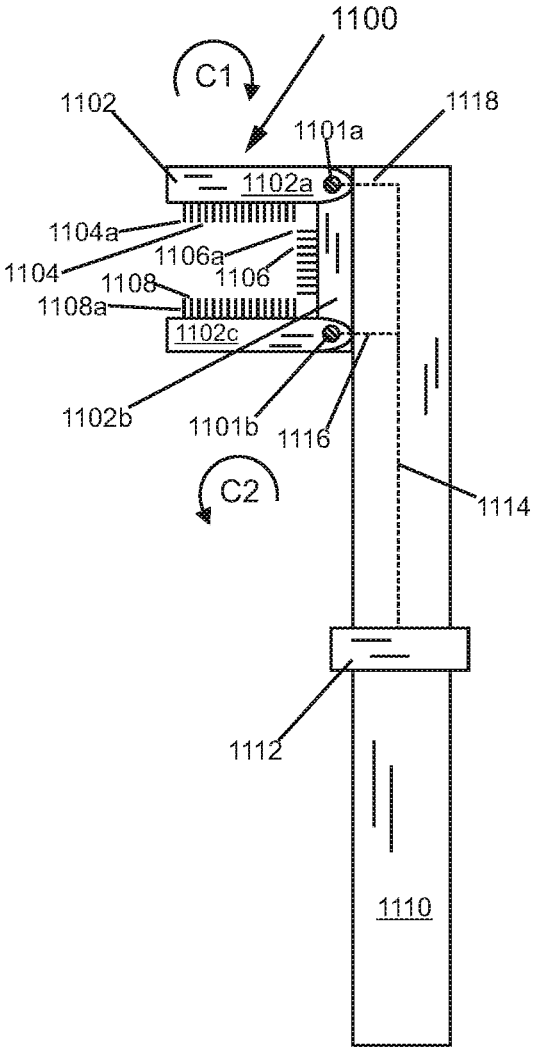
FIG. 12A is a simplified diagram of a side view of a twelfth tooth brush apparatus in accordance with another embodiment of the present invention, in a first state.
Figure 12B:
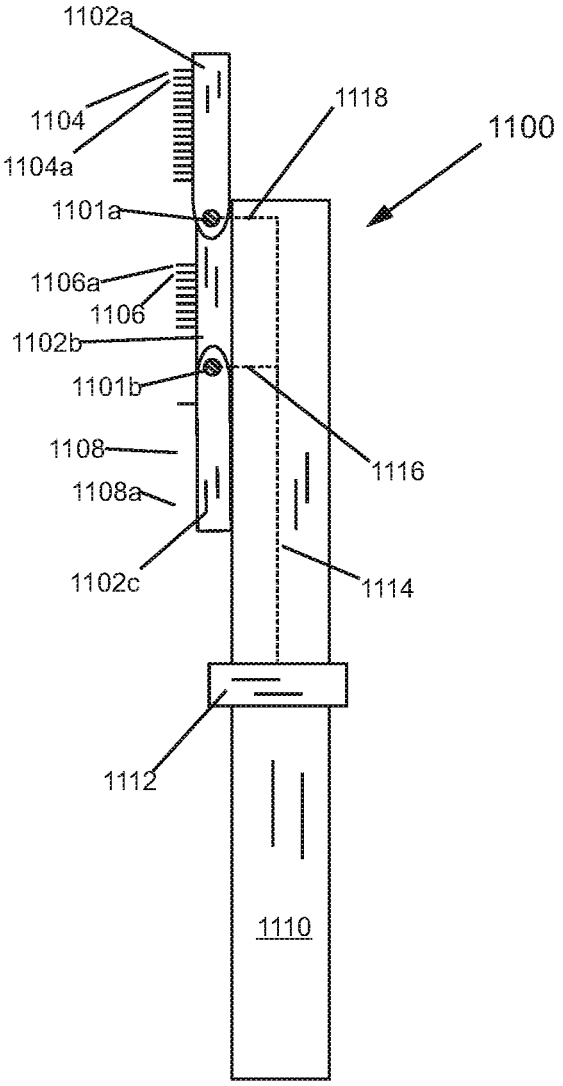
FIG. 12B is a simplified diagram of a side view of a twelfth tooth brush apparatus in accordance with another embodiment of the present invention, in a second state.

FIG. 12A is a simplified diagram of a side view of a twelfth tooth brush apparatus 1100 in accordance with another embodiment of the present invention, in a first state. FIG. 12B is a simplified diagram of a side view of the twelfth tooth brush apparatus 1100 in accordance with another embodiment of the present invention, in a second state.

FIG. 12A shows a simplified diagram of a side view of a tooth brush apparatus 1100 in accordance with another embodiment, in a first state. The apparatus 1100 may be similar or identical to the apparatus 100 of FIG. 2 except as will be described.

The tooth brush apparatus 1100 may include a U-shaped member 1102, and a handle member 1110.

The U-shaped member 1102 may include members or sections 1102*a*, 1102*b*, and 1102*c*. The member section 1102*a* may have a plurality of bristles 1104, including bristle 1104*a*, fixed to and protruding outwards from and perpendicularly to the member 1102*a*. The member or section 1102*b* may have a plurality of bristles 1106, including bristle 1106*a*, fixed to and protruding outwards from and perpendicularly to the member 1102*b*. The member or section 1102*c* may have a plurality of bristles 1108, including bristle 1108*a*, fixed to and protruding outwards from and perpendicularly to the member 1102*c*.

The components 1102, and 1110 may be made of hard plastic. The bristles 1104, 1106, and 1108, may be made of any suitable known material for tooth brush bristles.

Unlike the apparatus 100 of FIG. 2, the members 1102*a* and 1102*c* are rotatably mounted to the member 1102*b* by pin devices 1101*a* and 1101*b*, respectively. In at least one embodiment, the member 1102*a* is configured to be rotated, about the pin device 1101*a* and in at least one embodiment by a motor which may be part of the pin device 1101*a*, from an orientation, perpendicular to the handle 1110 shown in FIG. 12A to an orientation, parallel to the handle 1110, and parallel to member 1102*b*, shown in FIG. 12B. Similarly or identically, the member 1102*c* is configured to be rotated, about the pin device 1101*b* and in at least one embodiment by a motor which may be part of the pin device 1101*b*, from an orientation, perpendicular to the handle 1110 shown in FIG. 12A to an orientation, parallel to the handle 1110, and parallel to member 1102*b*, shown in FIG. 12B.

The member 1102*a* may be configured to be rotated clockwise, in the direction C1, with respect to the handle 1110, while the member 1102*c* may be configured to be rotated counterclockwise, in the direction C2, with respect to the handle 1110, from the orientation shown in FIG. 12, to the orientation shown in FIG. 12B.

In at least one embodiment, an activation device, such as a knob 1112 may be turned or pushed or otherwise moved to cause a signal to be sent via communications lines 1114 and 1116 to pin device 1101*b*, which causes pin device 1101*b* to turn the member 1102*c* from the state of FIG. 12A to the state of FIG. 12B, in the counter clockwise direction, C2, and a signal simultaneously to be sent via communications lines 1114 and 1118 to pin device 1101*a*, which causes the pin device 1101*a* to turn the member 1102*a* from the state of FIG. 12A to the state of FIG. 12B, in the clockwise direction C1.

The activation device or knob 1112 may be moved or turned to cause the apparatus 1100 to go from the state of FIG. 12A to the state of FIG. 12B, and then the apparatus 1100 can be used in the state of FIG. 12B to clean a person's tongue and gums. The alignment of the members 1102*a*, 1102*b*, and 1102*c*, and related bristles 1104, 1106, and 1108, presents a larger number of aligned bristles which is helpful for cleaning the tongue and gums of a person's mouth.

The activation device or knob 1112 may be moved or turned back to its original state of FIG. 12A to cause the apparatus 1100 to return to the state of FIG. 12A from the state of FIG. 12B.

Figure 13A:
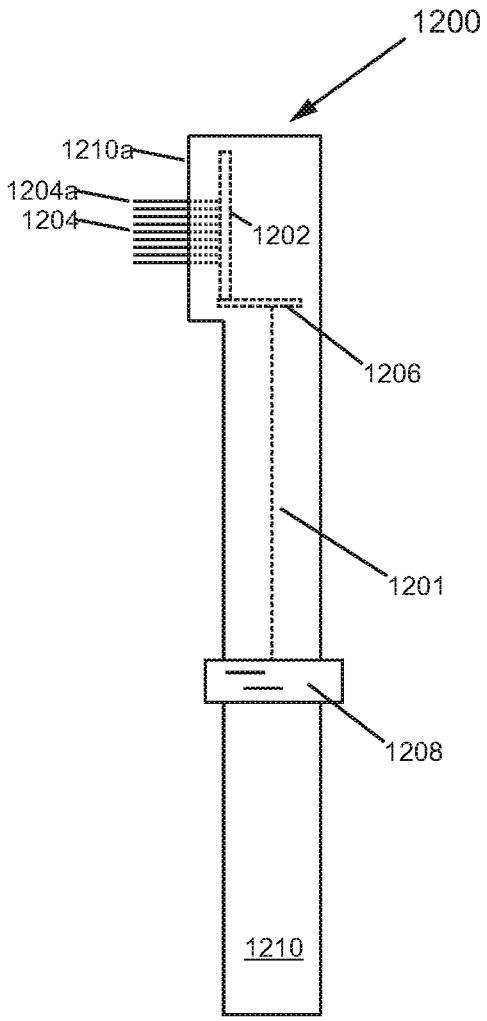
FIG. 13A is a simplified diagram of a side view of a thirteenth tooth brush apparatus in accordance with another embodiment of the present invention, in a first state.
Figure 13B:
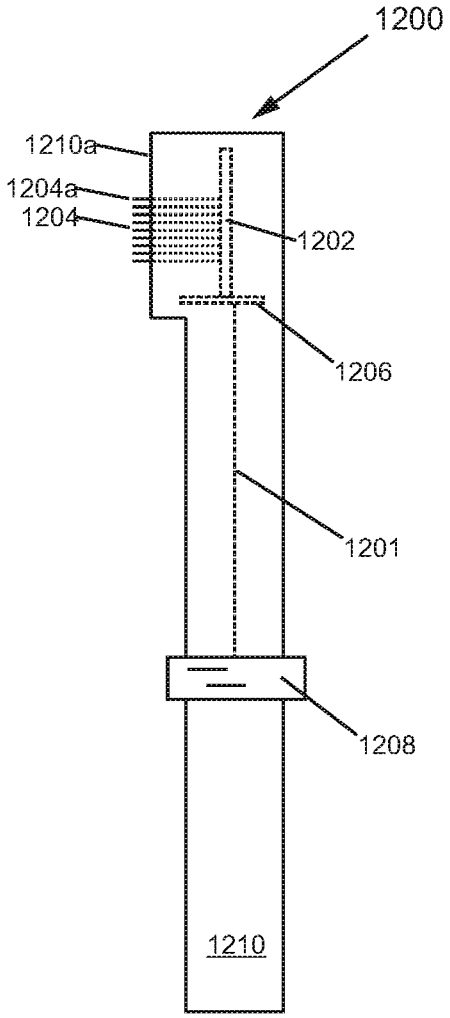
FIG. 13B is a simplified diagram of a side view of a thirteenth tooth brush apparatus in accordance with another embodiment of the present invention, in a second state.

FIG. 13A is a simplified diagram of a side view of a thirteenth tooth brush apparatus 1200 in accordance with another embodiment of the present invention, in a first state. FIG. 13B is a simplified diagram of a side view of a thirteenth tooth brush apparatus 1200 in accordance with another embodiment of the present invention, in a second state.

FIG. 13A shows a simplified diagram of a side view of a tooth brush apparatus 1200 in a first state. The tooth brush apparatus 1200 includes a moveable plate 1202, a plurality of bristles 1204, including bristle 1204*a*, fixed to the movable plate 1202 and protruding outwards substantially perpendicularly or perpendicularly from the movable plate 1202. The apparatus 1200 also includes a rail and/or motor device 1206 on which and by which the plate 1202 is configured to be moved. The rail and/or motor device 1206 communicates by a communication line 1201 with an activation device or knob 1208. The apparatus 1200 includes a housing 1210, in which the components 1202, 1206, and 1201 are located. The activation device or knob 1208 may be turned and/or moved while attached to the outside of the housing 1210 to cause a signal to be sent via communications line 1201 to the rail or motor device 1206 to cause the plate 1202 to move from the position shown in FIG. 13A to the position shown in FIG. 13B within the housing 1210.

In the state of FIG. 13A a greater portion of the bristles 1204 lies outside of the housing 1210 and therefore is usable in brushing someone's teeth. The portion of the bristles 1204 inside of the housing 1210 is shown by dashed lines. In the state of FIG. 13B a smaller portion of the bristles 1204 lies outside of the housing 1210. The bristles 1204 thus have become "shorter" from moving from the state of FIG. 13A to the state of FIG. 13B, and this is useful for providing stiffer bristles (when shorter) to more easily remove denture adhesive in FIG. 13B, while in FIG. 13A a softer more flexible feel with longer bristles is provided. In the apparatus 1200, the housing 1201 has a side 1210*a* having a plurality of narrow openings, not shown, and only one bristle is located in each opening. Each of the plurality of openings has a diameter about the side of the width or a bristle, and the narrow openings constrain the bristles 1204, and when the bristles are "longer" as in FIG. 13A, the part that a user can access outside the housing 1210 is more flexible, and when the bristles are "shorter" as in FIG. 13B, the part that a user can access outside of the housing 1210 is less flexible or stiffer.

One or more of the embodiments of FIGS. 1-13B may be provided together in a single kit, and the different embodiments may be compartments of a kit.

Each of the embodiments of FIGS. 1-13B may provide ultraviolet light to kill germs.

In at least one embodiment, a see through kit may be provided that holds one or more of the components shown in FIGS. 1-13B, such as for example a brush, C-shaped flossing head, and double headed water tooth pick. The kit may also have an ultraviolet light source to sanitize one or more of the components shown in FIGS. 1-13B between usages.

In at least one embodiment, tooth brush bristles, such as bristles 4, 6, 8, 14, 16, and 18 in FIG. 1, may be connected to a member which causes automatic oscillation of the bristles. For example, bristles 4 and 8 may be connected to members or sections 2*a* and 2*c*, respectively, in a manner which causes bristles 4 and 8 to oscillate, back and forth, in the directions D1 and D2 as shown in FIG. 1. The handle member 10 may include a power source, and the members or sections 2*a* and 2*c* may include motors, electrically connected to and powered by the power source of handle member 10, which cause the oscillation of the bristles 4 and 8. The bristles 6 may be connected to the member or section 2*b* in a manner which causes bristles 6 to oscillate back and forth in the directions D3 and D4, perpendicular or substantially perpendicular to the directions D1 and D2. The member or section 2*b* may include a motor which causes the oscillation of the bristles 6 in the directions D3 and D4, and which is electrically connected to and powered by the power source of the handle member 10. The power source of handle member 10 may include a battery and/or may be connected to an electrical socket for power.

Similarly, the toothbrush bristles shown in FIGS. 2-9, 12A-B, and 13A-B may be connected to motors which is connected to a power source in a handle, for causing the respective bristles to oscillate back and forth similarly or identically the embodiment of FIG. 1.

Each of the handles or handle members 10, 110, 210, 310, 410, 510, 610, 710, 810*a*, 810*b*, 902, 904, 1002, 1110, and 1210 may have a round cylindrical outer shell or housing, in which various components may be stored. The round cylindrical shell or housing may be configured to be inserted into a round or circular opening of a battery charger. The end of handles 10, 110, 210, 310, 410, 510, 610, 710, 810*a*, 810*b*, 902, 904, 1002, 1110, and 1210 near bristles may be curved or arced in accordance with known dental instruments.

Each of the embodiments shown by FIGS. 1-13B may have ultraviolet light sources to kill germs and sanitize all components. For example, an ultraviolet light source may be part of member or section 2*a* and may project ultraviolet light from 2*a* onto bristles 4. Alternatively, a separate ultraviolet light source may be provided in a kit, which can be used as a flashlight to kill germs and to sanitize all components.

A combination of one or more of the components shown in FIGS. 1-13B may be provided in a kit or apparatus 1300 such as shown in FIG. 14. FIG. 14 shows a top view looking down on the apparatus 1300. The apparatus 1300 may include a water reservoir for pick head compartment 1310, a heads water pick compartment 1312 (for an apparatus similar or identical to apparatus 900 in FIG. 10), a brushes and handle apparatus compartment 1314 (for any one or more of apparatus 1, 100, 200, 300, 400, 500, 600, 700, 800, 1100, and 1200), and a flossing head with handles compartment 1316 (for an apparatus similar or identical to apparatus 1000 of FIG. 11).

The kit or apparatus 1300 may include battery charger compartments 1318, 1320, and 1322 which may be configured to be connected to an electrical outlet for charging a battery within any of the handle members 10, 110, 210, 310, 410, 510, 610, 710, 810*a*, 810*b*, 902, 904, 1002, 1110, and 1210. The kit or apparatus 1300 may also include a compartment 1326 that may be a holding port for the apparatus 1000 shown in FIG. 11, or generally for flossing heads with the C-shape 1008*b* in the middle of the head as shown in FIG. 11.

The kit or apparatus 1300 may include an ultraviolet section 1324 which may provide ultraviolet light to all of the compartments 1312, 1314, and 1316 for sanitizing the respective components.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a handle; and a first U-shaped member and having first and second sections which are substantially parallel to each other and a third section which is substantially perpendicular to the first and second sections of the first U-shaped member, which connects the first and second sections of the first U-shaped member together;

wherein the first, second, and third sections of the first U-shaped member, together form a U-shape of the first U-shaped member;

wherein the first U-shaped member is attached to the handle;

and wherein a plurality of toothbrush bristles project from each of the first, second, and third sections; and further comprising a second U-shaped member haying first and second sections which are which are substantially parallel to each other and a third section which is substantially perpendicular to the first and second sections of the second U-shaped member and which connects the first and second sections of the second U-shaped member together;

wherein the first, second, and third sections of the second U-shaped member, together form a U-shape of the second U-shaped member;

wherein the second U-shaped member is attached to the handle, so that the U-shape of the first U-shaped member faces in a substantially opposite direction from the U-shape of the second U-shaped member;

wherein a plurality of toothbrush bristles project from each of the first, second, and third sections of the second U-shaped member;

wherein a first channel is located in the handle;

a second channel is located in the handle;

wherein the first channel allows a liquid to flow through at least part of the handle and into an area enclosed by first, second, and third sections of the first U-shaped member; and wherein the second channel allows a liquid to flow through at least part of the handle and into an area enclosed by first, second, and third sections of the second U-shaped member.

2. The apparatus of claim 1 further comprising a pumping device configured to pump liquid through at least part of the handle and into the area enclosed by first, second, and third sections of the first U-shaped member.

3. The apparatus of claim 1 further comprising a pumping device configured to pump liquid through at least part of the handle and into the area enclosed by first, second, and third sections of the first U-shaped member and through at least part of the handle and into the area enclosed by the first, second, and third sections of the second U-shaped member.

4. The apparatus of claim 1 wherein the first U-shaped member is rotatably mounted to the handle which permits the first U-shaped member to rotate with respect to the handle, while attached to the handle.

5. The apparatus of claim 1 wherein the first U-shaped member is rotatably mounted to the handle which permits the first U-shaped member to rotate with respect to the handle, while attached to the handle; and the second U-shaped member is rotatably mounted to the handle which permits the second U-shaped member to rotate with respect to the handle, while attached to the handle.

6. An apparatus comprising:

a handle; and a first U-shaped member and haying first and second sections which are substantially parallel to each other and a third section which is substantially perpendicular to the first and second sections of the first U-shaped member, which connects the first and second sections of the first U-shaped member together;

wherein the first, second, and third sections of the first U-shaped member, together form a U-shape of the first U-shaped member;

wherein the first U-shaped member is attached to the handle;

wherein a plurality of toothbrush bristles project from each of the first, second, and third sections;

wherein a first end of the handle is rotatably mounted to a base, and a second end of the handle, which is opposite the first end of the handle, is attached to the first U-shaped member.

7. An apparatus comprising:

a handle; and a first U-shaped member and having first and second sections which are substantially parallel to each other and a third section which is substantially perpendicular to the first and second sections of the first U-shaped member, which connects the first and second sections of the first U-shaped member together;

wherein the first, second, and third sections of the first U-shaped member, together form a U-shape of the first U-shaped member;

wherein the first U-shaped member is attached to the handle;

wherein a plurality of toothbrush bristles proiect from each of the first, second, and third sections; and further comprising a second U-shaped member having first and second sections which are which are substantially parallel to each other and a third section which is substantially perpendicular to the first and second sections of the second U-shaped member and which connects the first and second sections of the second U-shaped member together;

wherein the first, second, and third sections of the second U-shaped member, together form a U-shape of the second U-shaped member;

wherein the second U-shaped member is attached to the handle, so that the U-shape of the first U-shaped member faces in a substantially opposite direction from the U-shape of the second U-shaped member;

wherein a plurality of toothbrush bristles proiect from each of the first, second, and third sections of the second U-shaped member;

wherein the handle is comprised of first and second handle portions;

wherein a first end of the first handle portion is rotatably mounted to a base, and a second end of the first handle portion, which is opposite the first end of the first handle portion, is attached to the first U-shaped member; and wherein a first end of the second handle portion is rotatably mounted to the base, and a second end of the second handle portion, which is opposite the first end of the first second handle portion, is attached to the second U-shaped member.

8. A method comprising brushing an individual's teeth with an apparatus, wherein the apparatus is comprised of:

a handle; and a first U-shaped member and having first and second sections which are substantially parallel to each other and a third section which is substantially perpendicular to the first and second sections of the first U-shaped member, which connects the first and second sections of the first U-shaped member together;

wherein the first, second, and third sections of the first U-shaped member, together form a U-shape of the first U-shaped member;

wherein the first U-shaped member is attached to the handle;

and wherein a plurality of toothbrush bristles project from each of the first, second, and third sections; and wherein the apparatus is further comprised of:

a second U-shaped member having first and second sections which are which are substantially parallel to each other and a third section which is substantially perpendicular to the first and second sections of the second U-shaped member and which connects the first and second sections of the second U-shaped member together;

wherein the first, second, and third sections of the second U-shaped member, together form a U-shape of the second U-shaped member;

wherein the second U-shaped member is attached to the handle, so that the U-shape of the first U-shaped member faces in a substantially opposite direction from the U-shape of the second U-shaped member;

wherein a plurality of toothbrush bristles project from each of the first, second, and third sections of the second U-shaped member;

wherein a first channel is located in the handle;

a second channel is located in the handle;

wherein the first channel allows a liquid to flow through at least part of the handle and into an area enclosed by first, second, and third sections of the first U-shaped member; and wherein the second channel allows a liquid to flow through at least part of the handle and into an area enclosed by first, second, and third sections of the second U-shaped member.

9. The method of claim 8 wherein the apparatus is further comprised of:

a pumping device configured to pump liquid through at least part of the handle and into the area enclosed by first, second, and third sections of the first U-shaped member.

10. The method of claim 8 wherein the apparatus is further comprised of:

a pumping device configured to pump liquid through at least part of the handle and into the area enclosed by first, second, and third sections of the first U-shaped member and through at least part of the handle and into the area enclosed by the first, second, and third sections of the second U-shaped member.

11. The method of claim 8 wherein the first U-shaped member is rotatably mounted to the handle which permits the first U-shaped member to rotate with respect to the handle, while attached to the handle.

12. The method of claim 8 wherein the first U-shaped member is rotatably mounted to the handle which permits the first U-shaped member to rotate with respect to the handle, while attached to the handle; and the second U-shaped member is rotatably mounted to the handle which permits the second U-shaped member to rotate with respect to the handle, while attached to the handle.

13. A method comprising brushing an individual's teeth with an apparatus, wherein the apparatus is comprised of:

a handle; and a first U-shaped member and having first and second sections which are substantially parallel to each other and a third section which is substantially perpendicular to the first and second sections of the first U-shaped member, which connects the first and second sections of the first U-shaped member together;

wherein the first, second, and third sections of the first U-shaped member, together form a U-shape of the first U-shaped member;

wherein the first U-shaped member is attached to the handle;

and wherein a plurality of toothbrush bristles project from each of the first, second, and third sections;

wherein a first end of the handle is rotatably mounted to a base, and a second end of the handle, which is opposite the first end of the handle, is attached to the first U-shaped member.

14. A method comprising brushing an individual's teeth with an apparatus, wherein the apparatus is comprised of:

a handle; and a first U-shaped member and having first and second sections which are substantially parallel to each other and a third section which is substantially perpendicular to the first and second sections of the first U-shaped member, which connects the first and second sections of the first U-shaped member together;

wherein the first, second, and third sections of the first U-shaped member, together form a U-shape of the first U-shaped member;

wherein the first U-shaped member is attached to the handle;

and wherein a plurality of toothbrush bristles project from each of the first, second, and third sections;

wherein the apparatus is further comprised of:

a second U-shaped member having first and second sections which are which are substantially parallel to each other and a third section which is substantially perpendicular to the first and second sections of the second U-shaped member and which connects the first and second sections of the second U-shaped member together;

wherein the first, second, and third sections of the second U-shaped member, together form a U-shape of the second U-shaped member;

wherein the second U-shaped member is attached to the handle, so that the U-shape of the first U-shaped member faces in a substantially opposite direction from the U-shape of the second U-shaped member;

wherein a plurality of toothbrush bristles project from each of the first, second, and third sections of the second U-shaped member;

wherein the handle is comprised of first and second handle portions;

wherein a first end of the first handle portion is rotatably mounted to a base, and a second end of the first handle portion, which is opposite the first end of the first handle portion, is attached to the first U-shaped member; and wherein a first end of the second handle portion is rotatably mounted to the base, and a second end of the second handle portion, which is opposite the first end of the second handle portion, is attached to the second U-shaped member.

* * * * *